United States Patent [19]

Edwards et al.

[11] 4,161,142

[45] Jul. 17, 1979

[54] BLASTING BOOSTER AND METHODS

[75] Inventors: Donald W. Edwards, Lehighton, Pa.; Luther R. Wells, Jr., Glasgow, Ky.

[73] Assignee: Southern Explosives Corporation, Glasgow, Ky.

[21] Appl. No.: 836,714

[22] Filed: Sep. 26, 1977

[51] Int. Cl.[2] ..... C06B 31/28; C06B 33/04; F42D 1/00; F42D 3/00

[52] U.S. Cl. ..... 102/23; 102/24 R; 149/43; 149/46; 149/112

[58] Field of Search ..... 102/22–24; 149/43, 46, 112

[56] References Cited

U.S. PATENT DOCUMENTS

| | | | |
|---|---|---|---|
| 3,046,887 | 7/1962 | Brinkley, Jr. et al. | 102/22 |
| 3,046,888 | 7/1962 | Gordon | 149/46 |
| 3,111,437 | 11/1963 | Hino et al. | 149/112 |
| 3,305,414 | 2/1967 | Hodgson | 149/46 |
| 3,394,038 | 7/1968 | Minnick et al. | 149/46 |
| 3,534,685 | 10/1970 | Romocki et al. | 102/24 R |
| 3,760,728 | 9/1973 | McKee et al. | 102/24 R |
| 3,781,180 | 12/1973 | Harrison et al. | 149/46 |

*Primary Examiner*—Verlin R. Pendegrass
*Attorney, Agent, or Firm*—Wood, Herron & Evans

[57] ABSTRACT

A blasting booster comprises a rigid tube filled with a mixture, by weight, of about: 60% to 80% ammonium nitrate prills ground through a 1/16" screen; 12% to 35% whole ammonium nitrate prills and 3% to 8% diesel oil. Preferably the mixture includes about 0.4% to 10% aluminum fuel and the weight ratio of ground to whole prills is about 4 to 1. In use the booster tube is plastic lined and is placed in the bottom of a bore hole which is filled with AN-FO or an appropriate blasting agent. A one-pound cast primer on top of the booster is detonated to initiate the booster and the AN-FO, whereby detonation velocities and pressures in excess of non-boosted AN-FO, for example, are achieved in the critical bottom three feet of the bore hole. Bore hole patterns, where the booster is used, are expanded over tighter patterns required for non-boosted AN-FO alone, and drilling costs are significantly reduced.

36 Claims, 7 Drawing Figures

BLASTING BOOSTER AND METHODS

This invention relates to blasting, and more particularly to a blasting booster and methods for significantly decreasing the cost of a blasting operation by increasing bore hole detonation efficiency and thereby permitting expansion of bore hole patterns.

In a typical blasting operation, such as that used in a strip mining operation, a pattern of bore holes is drilled into the earth. These holes are at least partially filled with a blasting agent which is primed and detonated to fracture surrounding rock through which the holes are drilled. The broken rock can then be removed by earth moving apparatus.

In such an operation, rows of holes are typically drilled into patterns defined, for example, by notations such as 10'×12' or 13'×15'. In such notations, the first number indicates the distance in feet between each hole in a given row, while the second number indicates the distance in feet between each row. Thus, a 13'×15' pattern, for example, comprises rows of holes with 13 feet between each hole in a row, and 15 feet between each row. The holes themselves may be in the range of from about 16 feet to about 100 feet or more deep, and from 3"–15" in diameter, but these ranges vary according to the depth of fracture and breakage desired. Generally, the holes in such an operation are about 3" to 7" in diameter and about 30 to 50 feet in depth.

The pattern size, hole depth and hole diameter depend on a number of physical factors, including the nature of the rock which is to be fractured or broken up, and the efficiency of the blasting material used. The harder the rock, the tighter the pattern generally required for sufficient breakage.

Pattern size is critical to the blasting operator from an economic standpoint. While pattern size is primarily related to the physical nature of the blasting operation, the pattern size dictates the significant economic factor of drilling cost. Tighter patterns require significantly more drilling expense than looser patterns since more holes must be drilled. More particularly, the more holes which must be drilled, the more expensive the operation becomes due to increased drilling time, increased bit costs, and increased time of the drill apparatus on the particular drilling location.

While the bore hole pattern is directly related to the physical nature of the earth to be fractured, the pattern is also a function of the efficiency of the blasting material or agent used in the shoot. One typical blasting agent now in commercial use is a dry blasting agent known as AN-FO, a trade designation for a mixture of explosive grade ammonium nitrate prills and fuel oil in a ratio of about 94% to about 6% fuel oil.

When a dry blasting agent such as AN-FO is used in a blasting operation, it is common to place a primer, such as a cast primer or a 2"×8" stick of 60% special gelatin at the bottom of each hole in the pattern on top of a small amount of AN-FO, and then pour AN-FO into the holes on top of the primers. The AN-FO generally fills the holes, to within several feet of the top, and earth "stemming" is then placed on top of the AN-FO. The primers are then detonated by, for example, the use of detonating cord, known colloquially as "primacord", and the primers serve to detonate the AN-FO, each hole in the pattern being detonated similarly and at the appropriate delay to produce rock breakage.

The efficiency of the blasting agent or material used is in turn a function of the confined detonation velocity of the agent. The faster velocities result in greater pressure generated for rock fracture.

Detonation velocity of AN-FO varies according to the diameter of the bore hole; however, U.S. Department of Interior, Bureau of Mines, Information Circular 8405 (hereinafter I.C. 8405) lists confined detonation velocity of AN-FO as follows:

| Bore Hole Diameter | Confined Detonation Velocity | Loading Density pounds per foot of bore hole |
|---|---|---|
| 3" | 10,000–10,800 | 2.5–3.0 |
| 4" | 11,000–11,800 | 4.4–5.2 |
| 5" | 11,500–12,500 | 6.9–8.2 |
| 6" | 12,000–12,800 | 9.9–11.7 |

The same I.C. 8405 lists the density of AN-FO to be within the range of from 0.75 to 0.95. Thus assuming a density of about 0.9 in the bore hole, and based on a mean velocity taken from I.C. 8405 and the velocity values reproduced above, AN-FO is capable of producing the following pressures as calculated from the Nomograph on page 8 of I.C. 8405:

| Bore Hole Diameter | Mean Velocity | Detonation Pressure K/bar |
|---|---|---|
| 3"–4" | 10,900 | 26 |
| 5"–6– | 12,150 | 33 |

Despite these velocities and pressures, tests have shown that AN-FO tends to detonate slowly within the first few feet from the primer, and does not reach its full velocity or pressure potential for at least 2 feet from the bottom of the hole. The failure of AN-FO to reach its potential at the bottom of the hole detracts from the efficiency of the blast or "shot" since maximum pressure at the bottom of the hole is desired for maximum rock fracture.

Thus, for example, in a typical blasting operation a cast primer is placed at the bottom of 48-foot deep holes and the holes are filled to within 8 feet of the surface with AN-FO. The remaining 8 feet is "stemmed" with earth. The AN-FO column is approximately 40-feet long, however, due to its initial slow burning characteristic, maximum detonation velocity and maximum pressure are not achieved until the detonation reaction has moved about two or more feet upwardly from the primer at the bottom of each bore hole. Accordingly, maximum velocity and pressure are achieved through only 37 or 38 feet of the AN-FO column, and not at the critical bottom area of the hole.

Accordingly, when using a blasting agent such as AN-FO in a particular rock material and formation, a bore hole pattern is selected as a function of the rock material, the result desired, and the known characteristics and efficiency of the blasting agent. Thus, for a particular shot, a bore hole pattern of 10'×10' may be selected, based on these factors.

Should the efficiency of the blasting material in the hole be improved, however, such that greater detonation velocities and pressures were produced at the bottoms of the holes, it would be possible to significantly expand the bore hole pattern to, for example, 14'×14' thereby requiring fewer holes and substantially reducing drilling costs without sacrificing rock fracture and breakage or ease of removing the fractured material.

Another factor detracting from the efficiency of the blasting agent AN-FO is that of moisture. Moisture frequently present in at least the bottom and on the sides of a bore hole retards the detonation reaction of the AN-FO and if excessive, may even cause a mis-fire. The degrading effect of moisture on AN-FO is illustrated in a publication by Ensign Bickford entitled "Emphasis on Blasting", Vol. 10, No. 1, April 1975. In that publication, 9–10% of water results in detonation failure, while 2–8% of water reduce detonation velocity from 11,000 ft./sec. to about 8,000 ft./sec.

In a prior attempt to overcome the moisture problem, AN-FO has been placed in plastic bags and the bags used in the wet holes. While this may have alleviated the moisture problem to some degree, it has not overcome the initial "slow burn" deficiency of the blasting agent. Moreover, if the bags are torn, moisture creeping into the agent usually renders the detonation velocities erratic.

Accordingly, it has been one objective of this invention to improve the efficiency of a blasting operation by increasing detonation velocity and pressure at the bottom of a bore hole.

Another objective has been to provide improved methods for blasting whereby bore hole patterns are expanded and drilling costs are significantly reduced.

Another objective has been to provide a booster for a bore hole blasting operation and methods for making same.

Still another objective has been to provide blasting apparatus and methods for eliminating the degrading effect of moisture, particularly at the bottom of a bore hole.

To these ends, a preferred embodiment of the present invention comprises a booster for improving detonation in a bore hole blasting operation. We have discovered that a booster mixture, including ammonium nitrate prills ground through a 1/16" screen, and whole ammonium nitrate prills, preferably in the ratio of 80/20, ground to whole, when packed in a rigid package, produces substantially higher detonation velocities and pressures than does unboosted AN-FO, even when AN-FO is packed in flexible bags. The specified 80/20 ratio, in combination with the particular grind size, provides a booster having an optimum pack density in a rigid package.

The preferred booster comprises a rigid tube packed with a mixture having a density of about 1.10 to about 1.12 and comprising about, by weight: 12% to 35% whole ammonium nitrate prills; 60% to 80% ammonium nitrate prills ground through a 1/16" screen; 0.4% to 10% aluminum fuel; and 3% to 8% of diesel oil. A ratio of ground to whole prills of about 80/20 gives by far the best results in terms of detonation velocity, but ratios in the ranges of about 90/10 to about 60/40 give results which are an improvement in comparison to the prior practices. Also, it should be noted that while the above is preferred, the invention contemplates a mixture according to the above with no aluminum fuel.

The booster tube is preferably formed from spiral wound paperboard and the mixture is packed into a plastic bag inserted into the tube. A lower end of the tube is rounded and closed while the upper end is open, the plastic bag being closed and a restraining tape and handle disposed over the open end.

In use, a booster package is preferably dropped or lowered into each bore hole in the pattern, and a primer such as a one-pound cast primer, is dropped onto the top of the booster. Each hole is then filled with AN-FO, stemmed, and the columns of AN-FO detonated by the primers and boosters.

Tests of the rigid boosters filled with mixtures within the ranges specified have shown that the booster produces unconfined detonation velocities and pressures (again using the Nomograph from I.C. 8405, page 8 and assuming a density of 1.10) approximately as follows:

| Diameter of Booster | Unconfined Detonation Velocity | Detonation Pressure |
|---|---|---|
| 4" | 12,195 | 37.5 |
| 5" | 14,164 | 50 |
| 6" | 15,528 | 60 |
| 7" | 16,026 | 65 |

The velocity and pressure improvements for each booster diameter, over non-boosted AN-FO in the bore hole of similar diameter, are clearly significant, particularly in light of the fact that the detonation velocities of the preferred boosters are unconfined measurements, in contrast to the recited confined velocities of AN-FO. Since unconfined velocity measurements are generally 70 to 80 percent of confined velocities for the same agents (I.C. 8405), the actual effective in-use improvement in detonation velocity and pressure of the preferred booster is even more significant.

Additionally, since the booster material is sealed in a plastic bag within the tube, moisture in the bore hole does not affect its detonation. If the water level is higher than the booster is long, additional boosters are stacked on the first until water level is reached, and the hole thereafter filled with AN-FO.

In an alternative embodiment, 1% to 3% by weight of a water blocking compound is added to the booster mixture. This provides significantly increased resistance to any moisture degradation of the booster, should the plastic bag by accidentally punctured.

Due to the increased velocities and pressures produced by the boosters of the invention, equivalent rock fracture and breakage can be provided with bore hole patterns expanded beyond currently typical patterns used with nonboosted AN-FO; holes can be drilled further apart, and rows can be spaced further apart. Such expanded patterns substantially reduce the total number of holes required, reduce bit costs, and reduce the drilling time at a particular location. These savings substantially overcome the increased cost of using the booster, and the whole blasting operation becomes significantly more economically and physically efficient.

Finally, booster mixtures according to the invention herein are blasting agents classified as oxidizers, not explosives. The material is not detonation-sensitive to a No. 8 blasting cap. It thus can be conveniently transported and stored on site, without any special transportation or magazine requirements.

These and other objectives and advantages will become readily apparent from the following detailed description of the invention and from the drawings in which.

Figure 1:
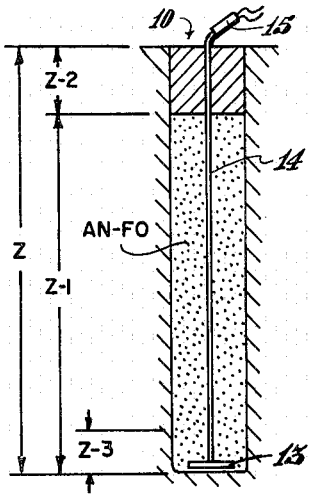
FIG. 1 is an illustrative view of a single bore hole loaded with a blasting agent according to known practice.
Figure 6:
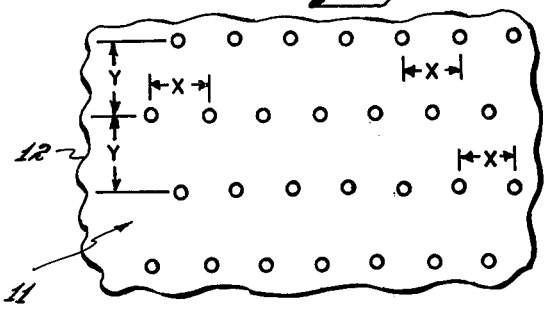
FIG. 6 is an illustration of a bore hole pattern.

Turning now to the drawings, FIG. 1 illustrates a typical bore hole 10 in condition to be blasted. Bore hole 10 may be one of a plurality of holes in a bore hole pattern 11, FIG. 6, designated by the formula 10′×12′ for example, where the first number 10 is the footage distance X between each hole in any row, and the second number 12 is the footage distance Y between each row in the pattern. This formula thus is related to hole and row spacing and does not indicate the particular number of holes or rows in a pattern. For any predetermined normal blast area filled with holes, however, it will be appreciated that an area 12 drilled on a 10′×12′ pattern contains more holes than the same area drilled on 13′×15′ pattern.

Bore holes vary greatly in diameter. Generally such holes range from about 3 or 4 inches to about 15 inches, although this may be varied according to the result desired. As will be generally appreciated, detonation velocities of AN-FO, and of the booster according to this invention, increase as the bore hole diameters increase.

Typically, bore holes 10 are drilled vertically into a rock surface to a varying depth, usually within a range of about 16 feet to about 100 feet or more, and more particularly of from about 30 feet to about 50 feet, depending on the type of rock, coal seam depth, and the result desired. Thus, the hole is usually surrounded by rock, as indicated in FIG. 1, upper layers of topsoil having been removed.

In a normal blasting operation, a primer such as a one-pound cast primer 13 is normally disposed in the bottom of the hole and the hole is partially filled with a common blasting agent such as AN-FO or slurry. AN-FO is a commonly used trade designation for a mixture of explosive grade ammonium nitrate whole prills and of fuel oil, in the respective percentages of about 94% prills, and 6% fuel oil. Such ammonium nitrate prills are commercially available from a number of suppliers such as U.S. Steel Corporation, Chemicals Group; DuPont de Nemours; Hercules Powder Corporation, and the like. Finally, the hole is stemmed or plugged with earth, normally about 6–15 feet in depth.

In FIG. 1, a hole 10 is drilled to a depth Z of about 48 feet. The lower 40 feet of the hole, distance Z-1, is filled with AN-FO, and the hole is then completely filled with a plug or stem of earth of about 8 feet in length (Z-2).

Once all the holes have been prepared, the "shot" is made by detonating the primers in all holes in the pattern simultaneously, or upon a prearranged sequence. Detonation of the primer is achieved via detonating cord 14 and electric blasting cap 15. Alternately, blasting caps on the primer could be used. Since detonating cord will detonate only a Class A explosive, it will not detonate AN-FO which is classified as an oxidizer. The cord thus has no other significance in the bore hole in detonating the AN-FO, other than for detonating the primer.

Figure 7:
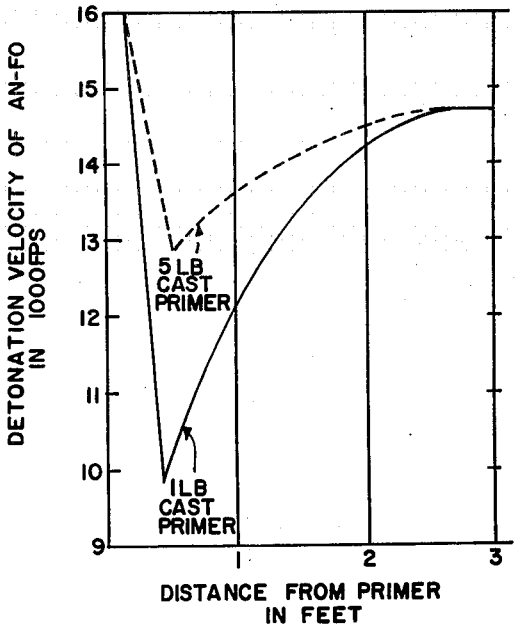
FIG. 7 is a graph illustrating the slow-burn detonation velocity characteristic of AN-FO at measured distances from typical primers.

Tests have shown that AN-FO, as previously described, does not reach its maximum detonation velocity or pressure until the reaction travels a distance Z-3 from the primer, and usually about 2 feet. The graph of FIG. 7, taken from the periodical entitled "Emphasis on Blasting", published January 1975, Vol. 10, No. 4, illustrates this "slow burn" effect in AN-FO detonated by both one and five pound cast primers. Other primers in greater weights, such as 50 lbs of either aluminized dry mix primer, dynamite primer, or aluminized or emulsion slurry primer have somewhat similar effects, but have been omitted from the graph, since no meaningful data within two feet from such high energy primers was included.

Thus, the "shot" achieves maximum velocity and pressure only for a distance Z-1 minus Z-3, which is less than the total length Z-1 of the AN-FO column. Moreover, maximum velocity and pressure are not produced at the bottom of the hole through the 2 foot distance Z-3 where it is needed the most.

Figure 3:
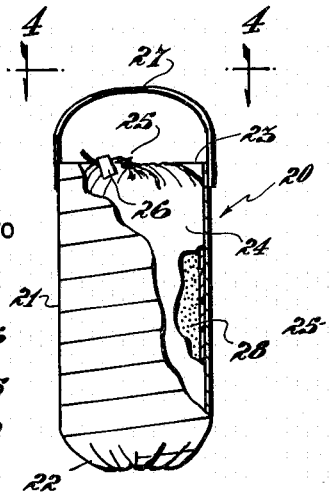
FIG. 3 is a broken elevational view of a booster according to the invention.
Figure 4:
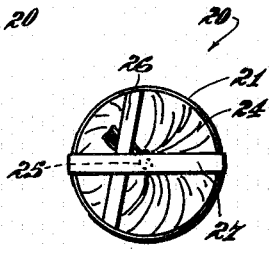
FIG. 4 is a top view taken along lines 4—4 of FIG. 3.

The performance and efficiency of the shot is significantly improved by booster means according to the present invention. A preferred embodiment of a booster means 20 of the present invention is illustrated in FIGS. 3 and 4 and includes a rigid tube 21, about three feet in length. The tube is made from a wound paperboard spiral, made from kraft paper. Any similarly rigid tube is believed to be suitable.

As shown in FIG. 3, a lower end 22 of the tube 21 is crimped or otherwise closed off forming a rounded nose. For tubes 4 inches or smaller, the lower ends of the tube could be closed off flat. In any event, the upper end 23 of the tube is open.

Within the tube 21 is a plastic bag 24, preferably of polyethylene about 8 mils in thickness, although any suitable water resistant material could be used. The bag is filled with a mixture, according to the invention, for significantly improving detonation velocity and pressure at the bottom of the bore hole. The lower end of the bag, not shown, is closed, and the upper end of the bag is gathered and sealed, for example, with a "tiper" tie 25 or some other suitable closure. After the bag is closed, a strip of tape 26 is placed across the open upper end 23 of the tube 21 to hold the plastic material in place. A handle 27 comprising a further piece of tape, for example, is thus secured over the upper open end 23 of the tube at about right angles to the tape 26.

As mentioned, the bag 24 prior to closing is filled with a booster mixture 28, according to the invention, which provides significant detonation velocity and pressure increases at the bottom of the bore hole. We have discovered that the combination of a rigid package such as that described above, with our mixture 28 as will be described, produces such substantial detonation velocity and pressure at the bottom of the bore hole that the bore hole pattern can be significantly expanded over those for non-boosted AN-FO alone, drilling costs reduced, and consequently the total cost of the whole operation significantly lowered.

More particularly, the invention contemplates a mixture 28 with which the above described package is filled, comprising, by weight, about: 12% to 35% whole ammonium nitrate prills; 60% to 80% ammonium nitrate prills ground through one-sixteenth inch (1/16″) screen; and 3% to 8% diesel oil.

In preferred form, the mixture further includes, by weight, about 0.4% to about 10% aluminum.

The whole ammonium nitrate prills mentioned above and hereafter are prills or particles of ammonium nitrate purchased in the commercial market place from fertilizer companies, and from companies such as U.S. Steel Corporation, Chemicals Group; DuPont De Nemours; Hercules Powder Corporation; and others. Because of the grinding operation, either explosive grade or dense prills can be used. Such prills are spheres, typically about ⅛ inch in diameter.

The aluminum mentioned in the above formula and hereinafter is from a commercially available aluminum source. One such suitable source is the product of the Aluminum Metallurgical Granules Company, of Kansas City, Mo., sold in granular form under the trade designation "XX BLEND". Another source of aluminum is the ALFE blend made by the same manufacturer. This blend is supplied generally in granular form.

As hereinafter used for descriptive purposes, the terms "aluminum" or "aluminum fuel" refer to aluminum particles which could be in flake, powder or in granular form such as the XX BLEND.

The diesel oil mentioned in the above formula and hereinafter is ordinary commercially available diesel oil.

Finally, the reference in the above formula and hereinafter to ammonium nitrate prills ground through a 1/16" screen refers to whole ammonium nitrate prills which are reduced in size from the whole prill form to a size similar to that produced by grinding whole prills through a 1/16" screen. A particular grinding operation is hereinafter described.

Figure 5:
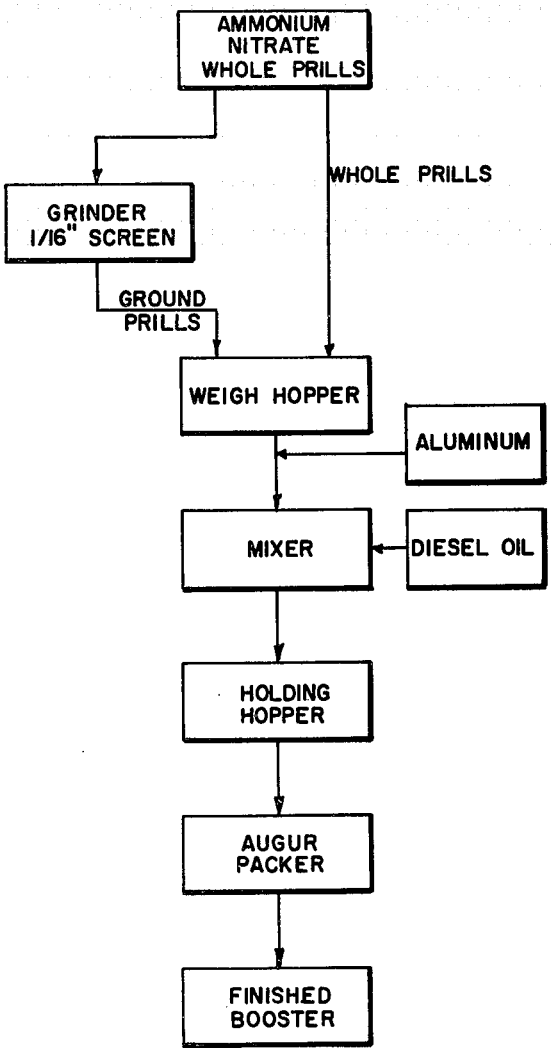
FIG. 5 is a diagrammatic flow chart illustrating a preferred method of making the booster of the present invention.

FIG. 5 illustrates the general steps of one method which has been satisfactorily used to produce a mixture 28 according to the invention. Preferably whole ammonium nitrate prills are placed into a grinder. While any suitable grinder will suffice, the particular grinder used in preparing booster mixtures according to this invention is manufactured by the Pulverizing Machinery Division of Mikropul, U.S. Filter Corporation of Summit, N.J. under the trade designation "No. 3 TH Micropulverizer". This grinder is, according to the invention, supplied with a 1/16" screen through which this whole prills are ground.

In the preferred method, whole prills are processed through the grinder to produce 800 pounds of ground prills which are placed in a weigh hopper. To this is added 200 pounds of whole ammonium nitrate prills. Thus, the ratio of ground to whole prills is about 80/20. From the weigh hopper, the combined prills are conveyed on a belt to a mixer. Preferably, the aluminum is added to the prills as they are conveyed toward the mixer. Also, other components, as will be described in connection with alternate embodiments, are added to the materials prior to or during mixing.

Once in the mixer, the whole prills, ground prills, and aluminum are mixed together and the diesel oil is added and mixed in the appropriate amount. While one mixer found suitable for the mixing step is a two ton drum mixer manufactured by the Wilson Welding Company of Cecilia, Ky., any suitable mixer will suffice.

From the mixer, the mixture is conveyed to a packer where a portion of it is packed into the rigid booster package 20 described above. While any suitable packer will suffice, one particular packer found to be useful is the augur packer known in the trade as the Amerind-Mackissick Cartridge Packer manufactured by Amerind-Mackissick Incorporated of Parkerford, Pa. In this packer, the plastic bag 24 is placed over a horn or sleeve and the closed end tube 21 is moved over the bag. The packer includes an augur which is rotated to move the mixture through the horn and pack it into the rigid booster package. The packing operation is conducted such that the packed material in the booster package is packed to a density of from about 1.10 grams per cubic centimeter to about 1.12 grams per cubic centimeter.

Thereafter, the booster package is removed from the packer and the booster means 20 completed by closing the plastic bag 24 and applying the tape 26 and handle 27 as described above.

In use, the booster is lowered or dropped into a bore hole and a primer 35, such as a one-pound cast primer, is placed on top of the booster, blasting cap 36 being attached to the primer. Generally the booster is selected so that its diameter is slightly less than the hole's diameter so there is about one quarter to one inch play between the booster side surfaces and the bore hole.

AN-FO is then poured into the hole ground and on top of the booster to an appropriate distance, the hole is stemmed, and then "shot" in conjunction with like prepared holes in the bore hole pattern, via an electrical charge energizing the blasting cap 36 through wires 37, 38. Alternately, primacord (not shown in FIG. 2) could be used to detonate the primer 35 similarly to the blasting cap, primacord, and primer combination shown in FIG. 1 without a booster.

Utilization of the booster means 20 described above produces significantly higher detonation velocities and pressures in the lower two feet of the bore hole, than does primed AN-FO when shot as illustrated in FIG. 1. Rock fracture and breakage are consequently increased and as a result, the bore hole pattern can be initially selected in a form which is substantially expanded over the pattern which would be required for equivalent rock fracture and breakage where primed AN-FO alone, as contrasted to boosted AN-FO as taught herein, is used.

When the primer detonates, detonation reaction is believed to travel downwardly in the booster and upwardly in the AN-FO at the same time. Since, however, the detonation velocities in the booster are substantially higher than those in the AN-FO, this reaction of the booster serves two functions. It first produces, on its own, desired detonation pressures at the very bottom of the bore hole throughout the distance Z-4. At the same time, the energy delivered to the lower end of the AN-FO column by the booster is believed to boost the initial detonation velocity of the AN-FO just above the booster and serves to reduce the extent of any initial "slow burn" of the AN-FO above the primer.

When the bore hole contains water, it will be appreciated that the booster according to the present invention is not affected, due to the water barrier properties of the plastic bag 24. Should the water level exceed the distance Z-4 (FIG. 2), additional boosters are placed on top of booster 20 to form a stack of boosters having an upper end above the water level. AN-FO is then poured into the hole on top of the booster stack, and is maintained above the water level so that the moisture does not degrade the AN-FO. In an extreme case of high water, it may be necessary to fill the hole up to the stemming level with boosters.

To further improve the water resistant qualities of the booster described herein should, for example, the plastic bag be broken, a water blocking compound can be added to the booster material. A suitable water blocking compound particularly useful in the booster material 28 described herein is "guar gum" such as that sold under the trademark "JAGUAR 100" by the Stein Hall Company, a division of Celanese, Incorporated. Such a water blocking compound is added to the mixture formula described above by an amount, by weight, of about 1% to about 3%.

The following are specific examples of rigid package boosters 20 according to this invention. Each of these examples, 1 through 7 is based on a booster mixture batch including about 800 pounds of ground ammonium nitrate prills formed by grinding through a 1/16" screen, as described herein, and about 200 pounds of whole ammonium nitrate prills, plus additives as will be described, and in the weight percentages shown dictated by the combined 1000 pounds of prills and additional additive weight. The components are ground, mixed and packed into a rigid booster package 20 as described herein. The ratio of ground prills to whole prills, by weight, is maintained as close as possible to 80/20 since we have discovered that the size of the ground prills compared to the whole prills and the ratio of ground prills to whole prills is important to the booster mixture and the results obtained when such a mixture is packed in a rigid package as taught herein. The grind size and ratio taught herein provides a maximum pack density in the rigid package enclosed and promotes increased velocities and pressures.

Also, it should be noted that each booster 20 is approximately three feet long and from 4 to 6 inches in diameter. Thus, each booster does not weigh 1000 plus pounds, but is filled with booster material from a mixture batch including 800 pounds of ground prills and 200 pounds of whole prills. The poundage recitations in the examples are included merely to illustrate the ground to whole prill ratios, and the batch weight of the mixture. The total of mixture in the actual booster is only a homogeneous portion of the batch.

Velocity tests of the boosters according to these examples are based on unconfined velocities determined by the D'Autriche method.

EXAMPLE 1

While an aluminum fuel component in the booster mixture is generally preferred, this example illustrates the advantages achieved by a booster mixture with an aluminum component. Several boosters of diameters from 4 to 6 inches were formed by packing booster packages 20 with a booster mixture 28 from a batch comprising about, by weight:

75.5% (800 lbs.) ground ammonium nitrate prills;
18.9% (200 lbs.) whole ammonium nitrate prills; and
5.6% (59.6 lbs.) diesel oil.

This mixture has a characteristic oxygen balance of +0.38.

Density of the booster material was tested by measuring the weight of a booster package 20 with bag 24 filled with water, and the weight of a production booster package 20 filled with the above material. Density of the material was calculated to be in the range of about 1.10 to about 1.12 g./c.c. by the formula:

$$\frac{\text{weight of package filled with water}}{1.0\ \text{g./c.c.}} = \frac{\text{weight of production booster}}{\text{density of booster material}}$$

Unconfined velocity tests on these boosters detonated by one pound cast primers detonated with #6 caps provides these results:

| Diameter | Unconfined Detonation Velocity |
|---|---|
| 4 inches | 11,442–11,561 |
| 5 inches | 12,755–13,020 |
| 5½ inches | 12,563–13,734 |
| 6 inches | about 13,768 |

As a comparison, the same booster material was packed in plastic bags without the rigid tube 21 and was detonated with one pound cast primers. The unsupported plastic bags did not permit the same pack density as that achieved by use of the rigid package. Unconfined detonation velocity tests produced the following results:

| Diameter | Velocity (ft./sec.) |
|---|---|
| 4 | 10,040–10,460 |
| 5 | 11,442 |
| 6 | 11,792 |

All measurements were taken from detonated boosters and bags laying on the ground.

According to the aforementioned I.C. 8405, AN-FO confined in the bore-hole has produced the following confined detonation velocities:

| Diameter | Confined Velocity (ft./sec.) |
|---|---|
| 3"–4" | 10,000–11,800 |
| 5"–6" | 11,500–12,800 |

These results indicate the significantly better results produced by the combination of the described rigid package and booster material over the same material in a non-rigid package such as that provided by the plastic bag. It should then be appreciated that the rigid booster package 20, combined with the booster material provided according to the disclosure herein, cooperates to produce a highly effective booster achieving significantly higher velocities over non-boosted AN-FO, as well as over the booster material above in a non-rigid package.

The improvements provided by the booster 20 are particularly significant in light of the fact that according to I.C. 8405, unconfined velocities are normally only 70% to 80% of confined velocities of the same material. The velocity results of the booster described herein are thus significantly greater in effect when the boosters are detonated in confined environment, such as in a bore-hole.

Exemplary detonation pressures were calculated for the booster according to this invention based on rounded off unconfined velocity measurements and on the nomograph in I.C. 8405. The following results were noted:

| Diameter | Detonation Pressure (K bar) |
|---|---|
| 4" (11,600) | 39 |
| 5" (13,000) | 44 |
| 5½" (13,500) | 45 |
| 6" (14,000) | 48 |

The actual effective pressures are substantially greater due to the use here of the smaller unconfined velocity figures.

In contrast, confined velocity calculations of AN-FO, assuming a density of 0.9 g./c.c. in the bore-hole, produced the following results:

| Diameter | |
|---|---|
| 3"-4" (10,900) | 26 |
| 5"-6" (12,150) | 33 |

EXAMPLE 2

Boosters were prepared according to the invention by filling booster packages 20 with a material from a batch comprising by weight:

74.6% (800 lbs.) ground ammonium nitrate prills;
18.7% (200 lbs.) whole ammonium nitrate prills;
0.5% (5 lbs.) aluminum fuel (XX Blend);
1.4% (15 lbs.) CBP-150; and
4.8% (51.8 lbs.) diesel oil.

This mixture had a characteristic oxygen balance of −0.34. Mixture density was similar to that of Example 1. CBP-150 was used an an additional source of aluminum fuel and was provided by the Aluminum Metallurgical Granules Company. This material is a combined mixture of carbon (75% by weight) and aluminum (25% by weight) believed to have been derived as a dust by-product of an aluminum recovery operation of that company. Thus, the total aluminum fuel component in this mixture is about 0.82%.

Unconfined detonation velocity and pressure calculations of these boosters produced these results:

| DIAMETER | UNCONFINED VELOCITY (ft./sec.) | DETONATION PRESSURES (K bar) |
|---|---|---|
| 4" | 12,195 | 37.5 |
| 5" | 14,164 | 50 |
| 6" | 15,528 | 60 |
| 7" | 16,026 | 65 |

The following field tests were conducted using boosters produced according to the disclosure herein and the mixture of this Example 2.

Figure 2:
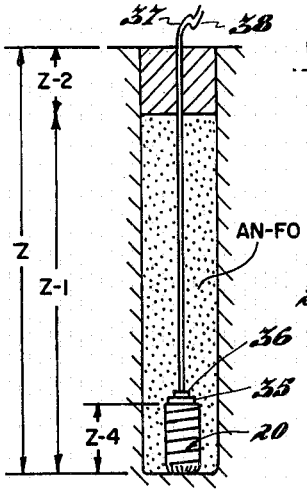
FIG. 2 is an illustrative view of a bore hole loaded with a blast agent and a booster of the present invention.

In one field test, 83 holes were drilled in a 14'×14' pattern, and one primed booster according to Example 2 was loaded into each hole, with AN-FO poured in on top as shown in FIG. 2. The result produced upon detonation was rock breakage in excess of that produced by primed, non-boosted AN-FO only (FIG. 1) in 10'×10' bore-hole patterns in the same rock material. The rock material in the shot area was easier to remove than that in the normal non-boosted 10'×10' pattern shots. Thus expanded bore-hole patterns and significant drilling costs reduction were achieved.

In a second field test, expanded bore-hole patterns of 13'×15', when initiated by a booster of this Example 2 in each hole (as in FIG. 2), produced such excellent breakage results over the normal 12'×12' patterns (without the booster) that even greater 15'×17' patterns in the same material were indicated to be useful.

EXAMPLE 3

Ferrosilicon and guar gum are used in this example to improve density and to add water resistance, respectively. In this example, which exhibits the best density of this form of mixture combination, a booster batch mixture was provided comprising, by weight:

67.2% (800 lbs.) ground ammonium nitrate prills;
16.8% (200 lbs.) whole ammonium nitrate prills;
8.8% (105 lbs. ferrosilicon;
2.0% (24 lbs.) guar gum;
0.4% (5 lbs.) aluminum fuel (XX Blend);
1.3% (15 lbs.) CBP-150; and
3.5% (41.9 lbs., 5.9 gal.) diesel oil.

This formula exhibited an oxygen balance of −6.7 and a density of 1.14 g./c.c. The ferrosilicon is a product of the Union Carbide Corporation and is in a 50/50 ratio, iron to silicon. While the density of the mixture was increased, testing of boosters with this formula was discontinued due to the relative high cost of ferrosilicon, not believed to be justified by the slight density increase. Again, since CBP-150 is about 25% aluminum, the total aluminum fuel component of this mixture is about 0.73%.

EXAMPLE 4

The following booster material formula is particularly useful where increased water blocking is desired. The batch mixture comprises, by weight:

74.2% (800 lbs.) ground ammonium nitrate prills;
18.6% (200 lbs.) whole ammonium nitrate prills;
2.0% guar gum;
0.9% aluminum fuel (XX Blend); and
4.3% diesel oil.

Oxygen balance of this formula is −1.8, while density is about 1.12 g./c.c.

Should the plastic bag 24 be opened or torn for any reason, the water blocking performance of the guar gum serves to inhibit degradation of the booster mixture and to reduce fluctuations in expected detonation velocities and pressures.

EXAMPLE 5

A booster formula according to this embodiment includes an aluminum source known in the trade as "ALFE", a granular combination of aluminum, at a mean of about 38.1%, and iron at a mean of about 69.9%. ALFE is supplied in drums and contains anywhere from about 30% to 70% aluminum, and 70% to 30% iron, respectively, however the material is preferably blended for use to a mixture having the mean percentages described. Density of the mean blend is approximately 98.8 lbs./cubic foot. This material is also sold by the Aluminum Metallurgical Granules Company. A booster batch made according to the invention comprises, by weight:

67.7% (800 lbs.) ground ammonium nitrate prills;
16.9% (200 lbs.) whole ammonium nitrate prills;
2.0% (23 lbs.) guar gum;
8.5% (100 lbs.) "ALFE"; and
4.9% (58.2 lbs.) diesel oil.

Oxygen balance of this formula is −5.69 and density is calculated at 1.14 g./c.c.

Unconfined detonation velocity of a 4 inch diameter booster 20, formed and packed according to this Example 5, is about 13,336 feet per second.

EXAMPLE 6

In this formula, the water blocking compound is omitted. A booster batch mixture according to the invention herein, comprises:

73.4% (800 lbs.) ground ammonium nitrate prills;
18.4% (200 lbs.) whole ammonium nitrate prills;

3.0% (33 lbs.) "ALFE"; and
5.2% (56.8 lbs.) diesel oil.

Oxygen balance of this mixture is −0.18, and density is within the range of about 1.10 to about 1.12.

EXAMPLE 7

A booster batch mixture for use in a rigid booster package 20 comprises about by weight:

74.8% (800 lbs.) ground ammonium nitrate prills;
18.7% (200 lbs.) whole ammonium nitrate prills;
1.0% (11 lbs.) aluminum fuel (XX Blend); and
5.5% (58.22 lbs.) diesel oil.

Oxygen balance of this mixture is −0.27, density is within the range of about 1.10 to about 1.12.

While these examples have shown highly beneficial boosters and methods, it should be recognized that other specific mixtures, falling within the ranges and packaged as described herein, may as well be useful as boosters. On the other hand, it should be noted that performance of the boosters is particularly related to the booster package and to material density which we have discovered is a function of the size of the ground ammonium nitrate prills, and the ratio of ground prills to whole prills. More particularly, tests on similar booster formulas wherein the ground prills were ground through a ⅛ inch screen did not produce consistent detonation results, especially in the 4 and 5 inch diameters. Using one stick of 2"×8" 60% special gelatin or one pound cast primers, 4 inch boosters made with ⅛ inch screened ground prills did not detonate while similar 5 inch boosters only partially detonated. Similar detonation failures and inconsistencies result from formulas using ground to whole prill ratios as follows: 70/30, 80/20, 90/10, 75/25, 50/50, 40/60 and 60/40.

Improved preferred results of the present invention have only been achieved wherein the ground prills are ground through a 1/16 inch screen and are in a ratio in an approximate range of from about 90 to 10, ground to whole prills, to about 60 to 40, ground to whole prills. Although mixtures within these ratios may be useful for particular booster diameter and applications, the 80/20 ratio specified has produced the most efficient results. The use of different ratios in mixtures according to the invention will vary the weight percentages of the ground and whole prills in the finished product within the percentage ranges described as contemplated by the invention.

Further, as illustrated herein, it should also be appreciated that the mixtures, including the particular grind size and prill ratio, when taken in combination with the booster package disclosed herein, produce a complete booster which significantly improves the efficiency of a blasting operation over the capabilities of either booster formula or package alone.

From the foregoing, it should thus be appreciated that the combination of the specific booster 20, in rigid package form, when coupled with the booster mixtures described herein, provides substantially increased detonation velocities and pressures at the bottom of boreholes. This permits expanded drilling patterns, thus substantially reduced drilling costs, and resulting reductions in overall blasting operation costs.

While these and other modifications and advantages will become readily apparent to those of ordinary skill in the art, without departing from the scope of the invention, and we desire to be bound only by the claims appended hereto.

We claim:

1. A booster means for improving detonation in a bore hole blasting operation and increasing initial detonation velocity and pressure, said booster means comprising:

a rigid tube, said tube containing a mixture of about, by weight:
12% to 35% whole ammonium nitrate prills;
60% to 80% ammonium nitrate prills ground through a 1/16" screen; and
3% to 8% diesel oil.

2. A booster means as in claim 1 wherein the ratio of said ground prills to said whole prills is about 80 to 20.

3. A booster means as in claim 2 wherein the mixture further includes about, by weight, 0.4% to 10% aluminum fuel.

4. A booster means as in claim 3 wherein said tube is lined with plastic.

5. A booster means as in claim 3 wherein said mixture comprises, by weight:
approximately 18.7% whole ammonium nitrate prills;
approximately 74.8% ammonium nitrate prills ground through a 1/16" screen;
approximately 1.0% aluminum fuel; and
approximately 5.5% diesel oil.

6. A booster means as in claim 5 wherein the density of said mixture is said tube is within the approximate range of from 1.10 to about 1.12 grams per cubic centimeter.

7. A booster means as in claim 6 wherein said tube is lined with a plastic liner, said mixture being disposed within said liner.

8. A booster means as in claim 6 wherein a lower end of said tube is closed and an upper end of said tube is open.

9. A booster means as in claim 6 wherein said booster is of a diameter of about 4 inches and the unconfined detonation velocity of said booster is about 11,500 feet per second.

10. A booster means as in claim 6 wherein said booster is of a diameter of about 5 inches and the unconfined detonation velocity of said booster is about 13,000 feet per second.

11. A booster means as in claim 6 wherein said booster is of a diameter of about 6 inches and the unconfined detonation velocity of said booster is about 14,000 feet per second.

12. A booster means as in claim 3 wherein said mixture comprises, by weight, about:
74.6% ground ammonium nitrate prills;
18.7% whole ammonium nitrate prills;
0.5% aluminum fuel;
1.4% mixture of aluminum and carbon in the ratio of about 25% aluminum to about 75% carbon; and
4.8% diesel oil.

13. A booster means as in claim 3 wherein said mixture comprises, by weight, about:
73.4% ground ammonium nitrate prills;
18.4% whole ammonium nitrate prills;
3.0% mixture of aluminum and iron in the approximate ratio of about 38% aluminum to about 62% iron; and
5.2% diesel oil.

14. A booster means as in claim 1, said mixture further including, by weight:
1% to 3% water blocking compound.

15. A booster means as in claim 14 wherein said mixture comprises, by weight:

approximately 18.6% whole ammonium nitrate prills;
approximately 74.2% ground ammonium nitrate prills ground;
approximately 2% water blocking compound;
approximately 0.9% aluminum fuel; and
approximately 4.3% diesel oil.

16. A booster means as in claim 15 wherein said water blocking compound comprises guar gum.

17. A booster means as in claim 14 wherein said mixture comprises, by weight, about:
67.7% ground ammonium nitrate prills;
16.9% whole ammonium nitrate prills;
2.0% guar gum;
8.5% mixture of aluminum and iron in the ratio of about 38% aluminum to about 62% iron; and
4.9% diesel oil.

18. A booster means as in claim 14 wherein said mixture comprises, by weight, about:
67.2% ground ammonium nitrate prills;
16.8% whole ammonium nitrate prills;
8.8% ferrosilicon;
2.0% guar gum;
0.4% aluminum fuel;
1.3% mixture of aluminum and carbon in the ratio of 25% aluminum to about 75% carbon; and
3.5% diesel oil.

19. A method of making a blasting booster comprising the steps of:
mixing together the following components, by weight:
12% to 35% whole ammonium nitrate prills;
60% to 80% ammonium nitrate prills ground through a 1/16" screen; and
3% to 8% of diesel oil;
to form a mixture, the ratio of ground prills to whole prills being about 80 to 20; and
packing said components into a rigid tube.

20. The method of claim 19 comprising the packing step of packing said mixture into said tube to obtain a mixture density of about 1.10 to about 1.12 grams per cubic centimeter.

21. The method of claim 19 wherein said mixture is packed into a plastic liner within said tube.

22. The method of claim 21 wherein a lower end of said tube is closed and the upper end of said tube is open, and including the further step of closing said liner over said mixture at said upper end.

23. The method of claim 19 including the step of mixing with said components, by weight:
1% to 3% water blocking compound.

24. The method of claim 19 wherein said mixing step includes mixing into said mixture, by weight, about 0.7% to 10% aluminum fuel.

25. A method of blasting a bore hole comprising the steps of:
inserting a booster means into said hole, said booster means comprising a rigid tube filled with a mixture of, by weight:
12% to 35% whole ammonium nitrate prills;
60% to 80% ammonium nitrate prills ground through a 1/16" screen; and
3% to 8% of diesel oil;
the ratio of ground prills to whole prills being about 80 to 20;
inserting a primer and a blasting agent into the hole over said booster; and
detonating said primed booster, and thereby detonating said blasting agent.

26. A method as in claim 25 wherein said tube is closed at a lower end, is lined with a plastic film, and is open at an upper end, said plastic film closed at said upper end, including the step of priming said booster by disposing a primer means adjacent said open end of said tube.

27. A method as in claim 25 wherein said bore hole is partially filled with water, and including the steps of inserting a plurality of boosters in said hole to form a stack of boosters having an upper end above said water.

28. A method as in claim 25 wherein said mixture includes, by weight, about 0.4% to 10% aluminum fuel.

29. A method as in claim 25 wherein said rigid tube is filled with a mixture of, by weight:
12% to 35% whole ammonium nitrate prills;
60% to 80% ammonium nitrate prills ground through a 1/16" screen;
0.4% to 10% aluminum fuel;
3% to 8% of diesel oil; and
1% to 3% of a water blocking compound.

30. A method of expanding the bore hole pattern in a blasting operation comprising the steps of:
drilling bore holes in an expanded pattern, relative to a tighter pattern for blasting with non-boosted blasting agent,
inserting a booster means into each hole in said expanded pattern, said booster means comprising a rigid tube filled with a mixture of, by weight:
12% to 35% whole ammonium nitrate prills;
60% to 80% ammonium nitrate prills ground through a 1/16" screen; and
3% to 8% of diesel oil;
inserting a primer and a blasting agent into each hole over said booster;
detonating said primed boosters, and thereby detonating said blasting agent to produce rock breakage in said expanded pattern equivalent to that produced by a blasting operation utilizing a non-expanded bore hole pattern without said primed booster means.

31. A method as in claim 30 wherein said tube is closed at a lower end, is lined with a plastic film, and is open at an upper end, said plastic film closed at said upper end, including a step of priming said booster means by disposing a primer means adjacent said open end of said tube.

32. A method as in claim 30 wherein said bore holes are partially filled with water, and including the steps of inserting a plurality of boosters in each said hole to form a stack of boosters having an upper end above said water.

33. A method as in claim 30 wherein said mixture comprises, by weight:
approximately 18.7% whole ammonium nitrate prills;
approximately 74.8% ammonium nitrate prills ground through a 1/16" screen;
approximately 1.0% aluminum fuel; and
approximately 5.5% diesel oil.

34. A method as in claim 30 wherein said rigid tube is filled with a mixture of, by weight:
12% to 35% whole ammonium nitrate prills;
60% to 80% ammonium nitrate prills ground through a 1/16" screen;
0.4% to 10% of aluminum fuel;
3% to 6% of diesel oil; and
1% to 3% of a water blocking compound.

35. A method as in claim 34 wherein said mixture comprises, by weight about:

18.6 % whole ammonium nitrate prills;
74.2% ammonium nitrate prills ground through a 1/16" screen;
2% water blocking compound;
0.9% aluminum fuel; and
4.3% diesel oil.

36. A method of expanding the bore hole pattern in a blasting operation comprising the steps of:

drilling bore holes in an expanded pattern, relative to a tighter pattern for blasting with non-boosted blasting agent, inserting a booster means into each hole in said expanded pattern, said booster means comprising a rigid tube filled with a mixture of about, by weight:

18.4% to 18.9% whole ammonium nitrate prills;
73.4% to 75.5% ammonium nitrate prills ground through a 1/16" screen, said prills being in the approximate ratio of 80 ground to 20 whole;
3% to 8% diesel oil;

inserting a primer and a blasting agent into each hole over said booster;

detonating said primed boosters, and thereby detonating said blasting agent to produce rock breakage in said expanded pattern equivalent to that produced by a blasting operation utilizing a non-expanded bore hole pattern without said primed booster means.

* * * * *

UNITED STATES PATENT AND TRADEMARK OFFICE

CERTIFICATE OF CORRECTION

PATENT NO. : 4,161,142

DATED : July 17, 1979

INVENTOR(S) : Donald W. Edwards and Luther R. Wells, Jr.

It is certified that error appears in the above-identified patent and that said Letters Patent are hereby corrected as shown below:

| | | | |
|---|---|---|---|
| Col. 2 | Line 31 | "5"-6-" | should be --5"-6"-- |
| Col. 4 | Line 42 | "by" | should be --be-- |
| Col. 14 | Line 27 | "is said" | should be --in said-- |

Signed and Sealed this

*Seventeenth* Day of *November 1981*

[SEAL]

*Attest:*

GERALD J. MOSSINGHOFF

*Attesting Officer*

*Commissioner of Patents and Trademarks*